US010675526B2

(12) United States Patent
Moyerman et al.

(10) Patent No.: US 10,675,526 B2
(45) Date of Patent: Jun. 9, 2020

(54) SPORTS APPARATUS AND METHODS INCLUDING TRACKING ADDITIVES

(71) Applicant: Intel Corporation, Santa Clara, CA (US)

(72) Inventors: Stephanie Moyerman, Phoenix, AZ (US); James Brian Hall, Tucson, AZ (US); Braxton Lathrop, Lake Oswego, OR (US)

(73) Assignee: Intel Corporation, Santa Clara, CA (US)

( * ) Notice: Subject to any disclaimer, the term of this patent is extended or adjusted under 35 U.S.C. 154(b) by 261 days.

(21) Appl. No.: 15/583,246

(22) Filed: May 1, 2017

(65) Prior Publication Data

US 2018/0311562 A1 Nov. 1, 2018

(51) Int. Cl.

| | |
|---|---|
| ***A63B 67/14*** | (2006.01) |
| ***A63B 71/06*** | (2006.01) |
| ***A63B 24/00*** | (2006.01) |
| ***A63B 69/00*** | (2006.01) |
| *A63B 102/24* | (2015.01) |

(52) U.S. Cl.

CPC ..... *A63B 71/0605* (2013.01); *A63B 24/0021* (2013.01); *A63B 67/14* (2013.01); *A63B 69/0026* (2013.01); *A63B 2102/24* (2015.10); *A63B 2209/08* (2013.01)

(58) Field of Classification Search

CPC ... A63B 67/14; A63B 63/004; A63B 69/0026; A63B 71/0605; A63B 2102/24; A63B 2024/0053; A63B 24/0021; A63B 2209/08

See application file for complete search history.

(56) References Cited

U.S. PATENT DOCUMENTS

| | | | | |
|---|---|---|---|---|
| 5,564,698 A | | 10/1996 | Honey et al. | |
| 5,863,255 A | * | 1/1999 | Mack | A63B 24/0021 473/151 |
| 5,912,700 A | * | 6/1999 | Honey | A63B 71/0605 348/157 |
| 5,947,846 A | * | 9/1999 | Craig | A63B 24/0021 273/127 B |
| 5,953,077 A | * | 9/1999 | Honey | H04N 5/262 348/589 |
| 5,976,038 A | * | 11/1999 | Orenstein | A63B 71/0605 342/127 |
| 6,148,271 A | * | 11/2000 | Marinelli | A63B 43/00 702/141 |

(Continued)

OTHER PUBLICATIONS

Shah, Prayag, et al., "A Review Paper on Goal-Line Technology", International Journal of Current Engineering and Technology E-ISSN 2277-4106, P-ISSN 2347-5161, (2014), 4 pgs.

*Primary Examiner* — Raleigh W Chiu

(74) *Attorney, Agent, or Firm* — Schwegman Lundberg & Woessner, P.A.

(57) ABSTRACT

Illustrative examples of a sports apparatus and methods for manufacturing a sports apparatus for sensing a scoring event, including but not limited to hockey pucks. In some examples, the sports apparatus includes a body formed of a substrate material and an additive embedded in the substrate material. The additive may be used by a sensor array to locate the position of the sports apparatus in relation to a sports goal. Example additives include an electronic object or a doping material.

25 Claims, 11 Drawing Sheets

(56) References Cited

U.S. PATENT DOCUMENTS 6,217,464 B1 * 4/2001 Chang ..... A63B 37/0003 473/351
6,252,632 B1 * 6/2001 Cavallaro ..... H04N 5/262 348/585
7,740,551 B2 6/2010 Nurnberg et al.
8,079,925 B2 * 12/2011 Englert ..... A63B 24/0021 473/569
8,702,099 B2 * 4/2014 Vanderberg ..... A63F 7/0005 273/126 A
8,786,415 B2 * 7/2014 Cavallaro ..... A63B 24/0021 340/323 R
9,228,859 B2 1/2016 Ranky et al.
9,242,142 B2 * 1/2016 Vincent ..... A63B 24/0021
2006/0148590 A1 * 7/2006 Sullivan ..... A63B 37/0003 473/371
2009/0072445 A1 * 3/2009 Brum ..... B29C 43/027 264/331.13
2009/0191988 A1 * 7/2009 Klein ..... A63B 24/0021 473/480
2010/0030350 A1 * 2/2010 House ..... A63B 24/0021 700/91
2010/0184563 A1 * 7/2010 Molyneux ..... A43B 1/0054 482/1
2012/0271440 A1 * 10/2012 Lunner ..... A63B 71/0622 700/91
2013/0120123 A1 * 5/2013 Aman ..... A63B 71/0669 340/323 R
2013/0130843 A1 * 5/2013 Burroughs ..... A63B 71/0686 473/415
2013/0324324 A1 * 12/2013 Ishii ..... A63B 45/00 473/376
2015/0180127 A1 6/2015 Bernhard et al.
2016/0001136 A1 * 1/2016 King ..... A63B 69/0071 320/108
2016/0074714 A1 3/2016 Krysiak et al.
2018/0065012 A1 * 3/2018 Mason ..... A63B 67/14
2018/0193694 A1 * 7/2018 Bergman ..... A43B 3/0005
2018/0311562 A1 * 11/2018 Moyerman ..... A63B 71/0605

* cited by examiner

SPORTS APPARATUS AND METHODS INCLUDING TRACKING ADDITIVES

TECHNICAL FIELD

This document pertains generally, but not by way of limitation to molded objects or sports apparatus, such as hockey pucks. Examples described herein may include embedded additives that facilitate tracking of the object for sensing a scoring event.

BACKGROUND

Hockey is a fast moving sport that involves passing a puck beyond a goal line to score a goal. In some cases, the sport is so fast moving that it is difficult to determine if a goal has been scored. There are particular rules to adhere to that determine if a goal was successfully scored that make the ability to view the puck important.

The current method of visually determining if a goal has been scored, has limitations. The ability to reliably determine if a goal has been scored may be limited by the viewing angle and may often be obstructed by players and other obstacles between the referee or video cameras and the puck. Video cameras may be useful in replaying the event, but even video cameras having a direct line of site may be limited by frame rate in such fast-moving sports.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

A technical problem faced in scoring fast moving sports games is reliably determining if the sports apparatus has passed the goal line and a goal has been scored. For example, in the fast moving sport of hockey, visual view of the puck may be occluded by players or other obstacles in the way of referees and video cameras. Technical solutions described herein include incorporating additives into the mold of an object. In various embodiments, the additive may include passive electronics (e.g., electronic object) or doping materials that may be sensed by sensing technology. In various examples, the sports apparatus is shown and described as a hockey puck, however, examples described herein may be used with other sports apparatus to score other sports games. Features of the disclosure may be incorporated into other sports apparatus including, but not limited to lacrosse balls and other apparatus that have solid or mostly solid cores.

The following description and the drawings sufficiently illustrate specific examples to enable those skilled in the art to practice them. Other examples may incorporate structural, logical, electrical, process, and other changes. Portions and features of various examples may be included in, or substituted for, those of other examples. Examples set forth in the claims encompass all available equivalents of those claims.

In a broad overview of this disclosure, FIGS. 1A and 1B, and FIGS. 2A and 2B show illustrative examples of a sports apparatus that may include a body formed of a substrate material and an embedded additive in the form of an electronic object for sensing a scoring event.

In another illustrative example of a sports apparatus, to be described later with respect to FIGS. 5, 6, 7A, 7B and 8, the sports apparatus may include a body formed of a substrate material where the embedded additive may be in the form of a doping material for sensing a scoring event.

The various examples provided herein describe different types of additives such as the electronic object or the doping material. While these additives are described separately in separate examples, a sports apparatus including more than one additive, such as a sports apparatus having both an electronic object and a doping material embedded therein, is within the scope of this disclosure.

The substrate material in any of the examples may include natural rubber, antioxidants, bonding materials and other chemicals to achieve a balance of hardness and resilience. Any suitable materials may be used as the substrate material. The materials and proportions of the materials may be selected so as to meet regulation sports apparatus specifications.

Figure 1A:
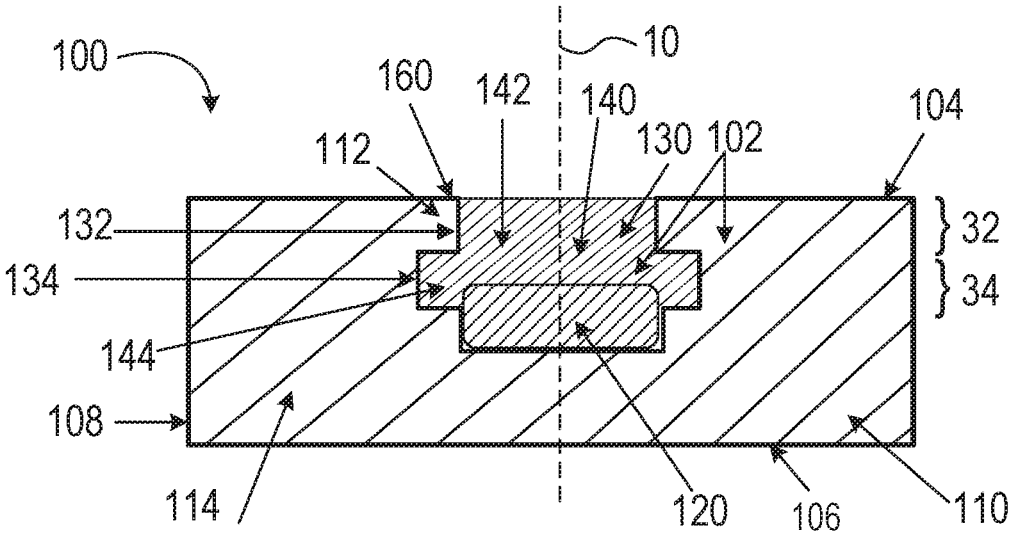
FIG. 1A is a cross-sectional side view illustrating an example sports apparatus, shown here in the non-limiting example of a hockey puck, the sports apparatus including an embedded additive, according to an embodiment. The cross-section is taken along line A-A' in FIG. 1B.
Figure 1B:
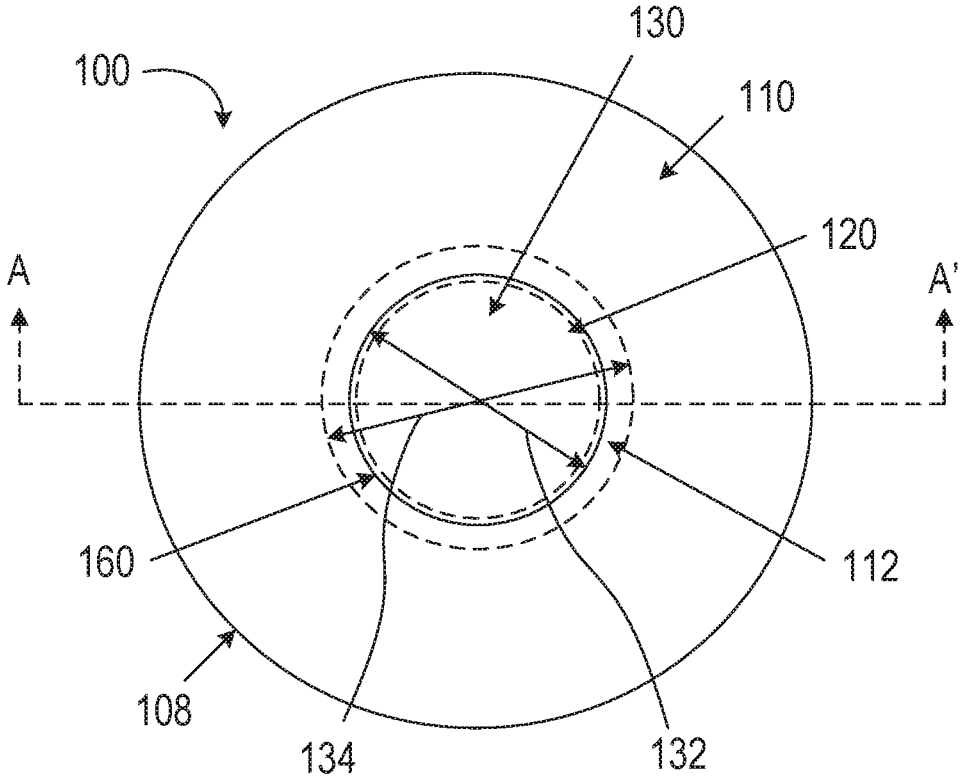
FIG. 1B is a top view of the sports apparatus of FIG. 1A, according to an embodiment.

FIGS. 1A and 1B show side and top views, respectively, of an illustrative example of the sports apparatus 100, according to an embodiment. As shown in the example of FIGS. 1A and 1B, the sports apparatus 100 includes a body 114 formed of a substrate material 102 and an additive 120 embedded in the substrate material 102. The additive 120 may be used by a sensor array to locate the position of the sports apparatus 100 in relation to a sports goal, such as a hockey goal.

In some examples, including the example illustrated in FIGS. 1A and 1B, the additive 120 may be an electronic object, such as a non-powered passive electronic object. The electronic object may include but is not limited to, radio-frequency identification (RFID) objects, or electromagnetic objects, receivers, transceivers, coils or antenna. Any suitable marker, tag or other object(s) may be used as a part of the additive 120, or as the additive 120. In some examples the electronic object may be a powered electronic object or an active powered electronic object. The term electronic object may refer not only to a single object but a combination of connected or discrete elements.

To securely embed the additive 120 within the sports apparatus 100, the present disclosure provides particular features, which when employed, lock the additive 120 into the body 114 of the sports apparatus 100. Even under the strenuous conditions encountered during a game, features of this disclosure prevent the embedded additive 120 from separating from the body 114 of the sports apparatus 100, or being unduly exposed to forces that would damage the additive 120.

As shown in the examples of FIGS. 1A and 1B, the substrate material 102 includes a first substrate 110 and a second substrate 130. Together, the first and second substrates 110, 130 cooperate to form the body 114 of the sports apparatus 100. In the example of a hockey puck shown in the figures, the first and second substrates 110, 130 may form a generally cylindrical shape extending along a longitudinal axis 10.

In the illustrative example, the first substrate 110 includes a shape that forms a portion of the sports apparatus 100. The first substrate 110 also includes features to permit the additive to be securely embedded in the sports apparatus 100. As perhaps best shown in FIGS. 1A and 1B, the first substrate 110 may include a first surface 104 opposite a second surface 106, and a circumferential outer surface 108 extending from the first surface 104 to the second surface 106. Also illustrated in FIGS. 1A and 1B, and further supported in FIG. 3A, the first surface 104 may include a recess 140 formed in the first surface 104 that is configured to accommodate the additive 120, and may also include an overhang 112. In addition to accommodating the additive 120, the recess 140 may be configured to receive at least a portion of the second substrate 130 therein. In this arrangement, the additive 120 is located in the recess 140 and is sandwiched between the first substrate 110 and the second substrate 130 (FIG. 1A).

Figure 3A:
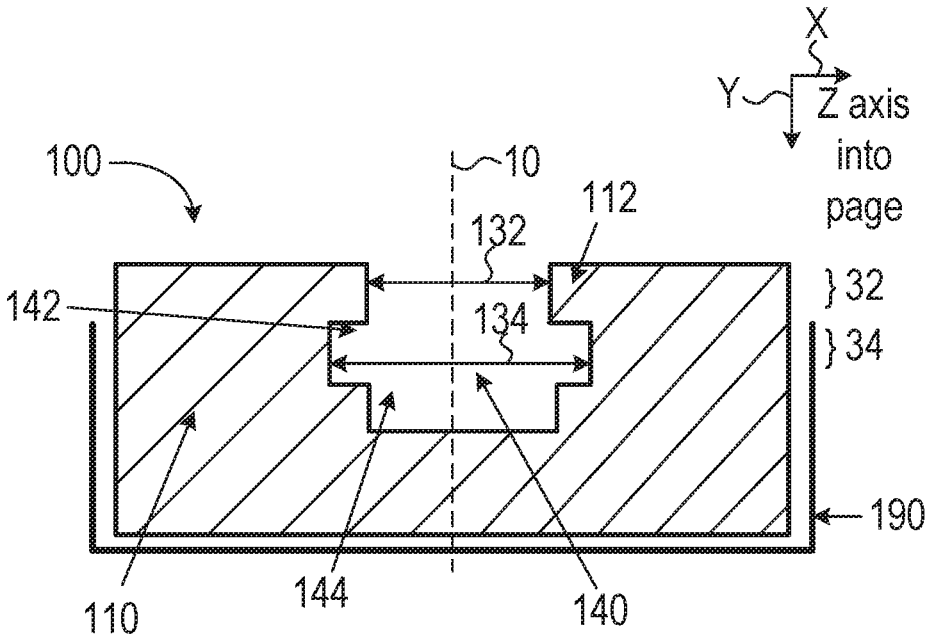
FIGS. 3A-3D are side views of an illustrative example of various operation in manufacturing the sports apparatus of FIGS. 1A and 1B, according to an embodiment.

As shown in the example of FIGS. 1A and 1B, with additional support in FIG. 3A, the recess 140 may vary in cross-section. For example, the recess 140 may have a stepped cylindrical shape. In other words, the recess 140 may be formed as a circular or cylindrical recess 140 having different diameters at different locations along the longitudinal axis 10 of the storage apparatus. For example, the recess 140 may have a first diameter 132 (FIG. 1B) at a first location or region 32 (FIG. 1A) along the longitudinal axis 10, and a second diameter 134 (FIG. 1B) at a second location or region 34 along the longitudinal axis 10 (FIG. 1A). The diameters 132, 134 are most easily viewed in FIG. 1B, which depicts a top view of the sports apparatus 100. The first and second locations or regions 32, 34 which show where the change in diameter may occur along the longitudinal axis 10 is most easily viewed in the side view of FIG. 1A. As shown in the example of FIGS. 1A, and 1B, the first diameter 132 may be located closer to the outermost surface of the first surface 104 than the second diameter 134, and the first diameter 132 may be smaller than the second diameter 134. The diameter may be defined along a plane orthogonal to the longitudinal axis 10 of the recess 140.

The examples of FIGS. 1A and 1B, depict the recess 140 having a circular cross-section (e.g., having a diameter). Whether the recess 140 is circular in nature or another shape, the recess 140 may also be described as having different cross-sectional areas at different points along the longitudinal axis 10 of the sports apparatus 100. For example, the recess 140 may include a first cross-sectional area (e.g., 132) at the first location or first region 32 along the longitudinal axis 10 of the recess 140, and a second cross-sectional area (e.g., 134) at a second location or second region 34 along the longitudinal axis 10. The recess 140 may be formed such that the first cross-sectional area 132 is different from the second cross-sectional area 134. In the example of FIGS. 1A and 1B, the first cross-sectional area 132 may be smaller than the second cross-sectional area 134. The first location or the first region 32 may be located closer to the outermost portion of the first surface 104 than the second location or the second region 34. In other words, the first location or the first region 32 may be located more distal from the bottom of the recess 140 than the second location and the second region 34. The cross-sectional area may be defined along the plane orthogonal to the longitudinal axis 10 of the recess 140.

In some examples, the recess 140 may have a non-circular cross-section. In such an example the recess 140 may also be described as having different cross-sections (e.g., different cross-sectional shapes) at different points along the longitudinal axis 10 of the sports apparatus 100. For example, the recess 140 may include a first cross-section (e.g., 132) at a first location or first region 32 along the longitudinal axis 10 of the recess 140, and a second cross-section (e.g., 134) at a second location or second region 34 along the longitudinal axis 10. The recess 140 may be formed such that the first cross-section is different in size, shape or orientation than the second cross-section. In the example of FIGS. 1A and 1B, the first cross-section may be smaller than the second cross-section. The first location or the first region 32 being located more distal from the base of the recess 140 than the second location or the second region 34. The cross-section may be defined along the plane orthogonal to the longitudinal axis 10 of the recess 140.

In some examples, and as shown in FIG. 1A, the recess 140 may be described as being formed in the first surface 104 of the first substrate 110 such that the recess 140 includes a combination of a longitudinal recess 142 and an axial recess 144 (FIGS. 1A and 3A). The longitudinal recess 142 extending along the longitudinal axis 10. Further, the recess 140 may include a portion having the axial recess 144 extending along a portion of the longitudinal recess 142. The axial recess 144 extend axially away from the longitudinal axis 10 such that an axial recess 144 is also formed in the first substrate 110 of the sports apparatus 100 in addition to the longitudinal recess 142.

The recess 140 may be formed in any suitable shape that securely embeds the additive 120 within the sports apparatus 100. In other examples, the first and second substrates 110, 130 and the recess 140 may take on other shapes, while incorporating the additive 120 embedding features presented here and still remain within the scope of the invention. For example, it is contemplated that in some examples, the first and second cross-sections may be different in shape from each other, but the same in cross-sectional area. Vice-versa, it is contemplated that the first and second cross-sections could be the same in shape as each other, but different in cross-sectional area. Different configurations between the portion of the recess 140 in the first region 32 and the portion of the recess in the second region 34 that result in the second substrate 130 being locked into the first substrate 110 are considered to be within the scope of this disclosure.

As shown in the illustrative example of FIGS. 1A and 1B, the additive 120 may be locked into the recess 140 of the first substrate 110 by the second substrate 130. In FIGS. 1A and 1B, the second substrate 130 may occupy all or at least a portion of the recess 140 that is not occupied by the additive 120. In this example, the second substrate 130 may be described as including a stepped cylindrical form having a first portion (e.g., at 32) and a second portion (e.g., at 34), where the second portion 34 may have a larger diameter than the first portion 32.

The first substrate 110 and the second substrate 130 join at the first surface 104 along a seam 160. The location of this seam 160, although on a surface viewable by the user, may be desirable because while it is located on the first surface 104, the seam 160 may be arranged so that it is easy to blend in or be covered up by a printed logo.

Figure 2A:
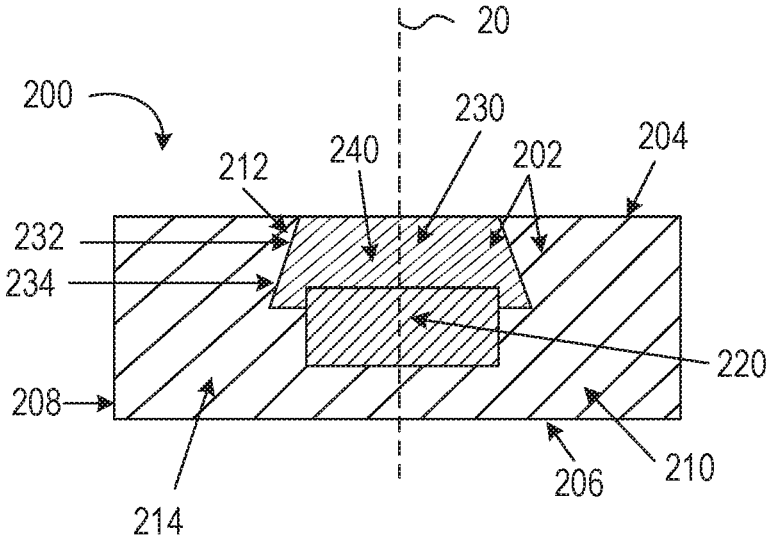
FIG. 2A is a cross-sectional side view illustrating another example sports apparatus including an embedded additive, according to an embodiment. The cross-section is taken along line B-B' in FIG. 2B.
Figure 2B:
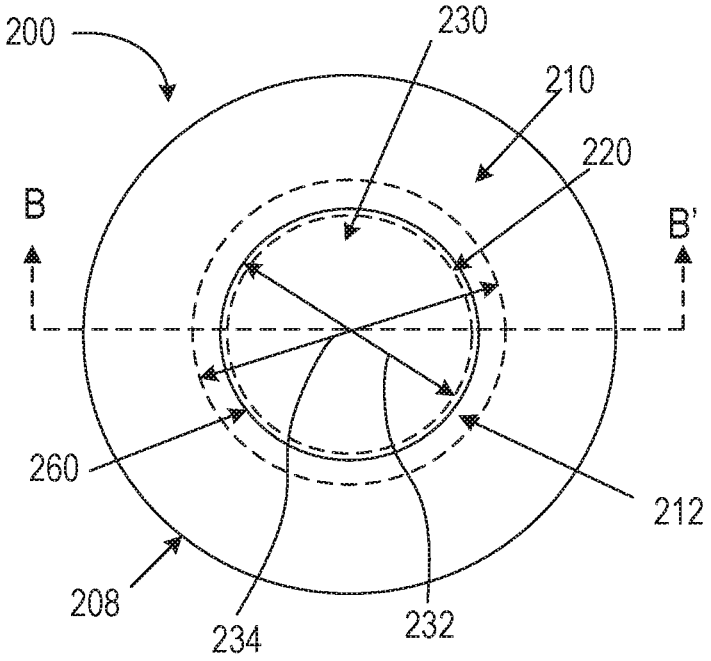
FIG. 2B is a top view of the sports apparatus of FIG. 3*a*, according to an embodiment. The cross-section is taken along line B-B' in FIG. 2B.

FIGS. 1A and 1B depict merely one example of the sports apparatus. The shape of the recess 140 in the first substrate 110 and the shape of the second substrate 130 may take on other forms other than the shapes shown in FIGS. 1A and 1B. FIGS. 2A and 2B, which share many similarities with the example of FIGS. 1A and 1B, show another example of a sports apparatus 200. The disclosure of FIGS. 1A and 1B may be applied to the example of FIGS. 2A and 2B, with like numerals representing like elements.

In the example of FIGS. 2A and 2B, the sports apparatus 200 may include a body 214 formed of a substrate material 202 that may include a first substrate 210 having a first surface 204 opposite a second surface 206 and a circumferential outer surface 208 extending from the first surface 204 to the second surface 206. Like sports apparatus 100, the first surface 204 may also include a recess 240 in the first surface 204 that is configured to accommodate an additive 220. The first substrate 210 also having an overhang 212.

The first substrate 210 may be generally similar to the sports apparatus described in FIGS. 1A and 1B. However, the recess 240 is shown having diameters 232, 234 that may vary more continuously or gradually along a longitudinal axis 20 than the example depicted in FIGS. 1A and 1B. In addition to the differences in recess 240 compared to recess 140, a second substrate 230 may also be formed having a more continuously varying cross-section than was shown with respect to the second substrate 130 of FIGS. 1A and 1B.

The diameter of the recess 240 in FIGS. 2A and 2B is shown as varying more continuously than stepped like the recess 140 of FIG. 1A. In other words, the characteristics of a variable diameter, variable cross-sectional area or variable cross-section (e.g., cross-sectional shape), as described with respect to the example of FIGS. 1A and 1B may apply, but here the variation may be more continuous. Like the more continuous variation along recess 240, the substrate 230 may also vary in diameter, cross-sectional area or cross-section shape or size, etc. in a more continuous manner than in FIG. 1.

In the example of FIGS. 2A and 2B, the second substrate 230 may be generally formed as a portion of a cone extending from the first surface 204 to the second surface 206. When the illustrative second substrate 230 of FIGS. 2A and 2B is formed in the recess 240 of the first substrate 210, an additive 220 located therein may be described as being locked into the first substrate 210 by the second substrate 230.

The examples of FIGS. 1A and 1B, and 2A and 2B demonstrate two of many possible arrangements of the geometry of a first substrate 110, 210, a recess 140, 240 and a second substrate 130, 230 that are within the scope of this disclosure. Other geometric shapes of recesses and second substrates that cause an additive to be locked into the first substrate, including combinations of stepped and continuous variations along the longitudinal axis of the recess and the second substrate, are considered to be within the scope of the present disclosure.

Features of the invention, including the recess 140, 240 and the second substrate 130, 230, may be incorporated into other sports apparatus besides a hockey puck. Such apparatus include but not limited to, a lacrosse ball. In the case of a lacrosse ball, the shape of a recess may be incorporated into a first substrate. The first substrate may be formed as a portion of a sphere, and the second substrate may be formed as another portion of the sphere. Like the examples of FIGS. 1A, 1B, 2A and 2B, at least a portion of the second substrate may fit within the recess of the first substrate such that when molded together, the first and second substrates form the ball with the additive 120 sandwiched between the substrates and embedded therein in a locking manner.

An illustrative example of a manufacturing method 400 for a sports apparatus will now be described with reference to FIGS. 3A-3D which show side views of manufacturing operations of a method 400 and FIG. 4 which shows an illustrative flow chart of the method 400.

The method 400 may be used in accordance with at least one of the example sports apparatus described herein, including, but not limited to, the sports apparatus 100 of FIGS. 1A and 1B, or the sports apparatus 200 of FIGS. 2A and 2B. For the purposes of illustration, the method 400 will be described as applied to the sports apparatus 100 of FIGS. 1A and 1B. The method 400 may also be used with other sports apparatus.

Figure 4:
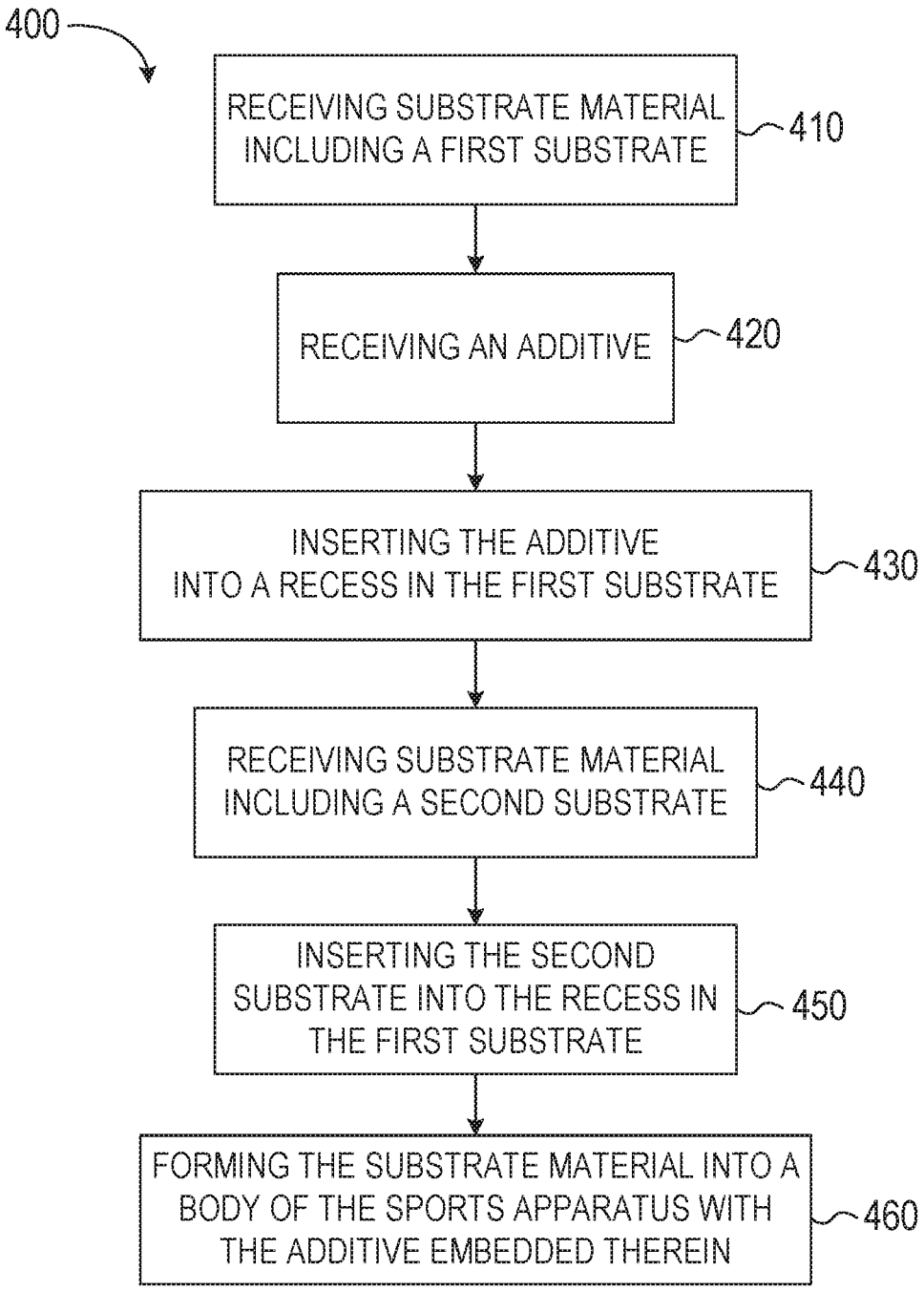
FIG. 4 is a flow chart illustrating a method of manufacturing a sports apparatus, including, but not limited to, the sports apparatus of FIGS. 1A and 1B, according to an embodiment.

In operation 410 of FIG. 4 and as depicted in FIG. 3A, the first substrate 110 may be received, for example, at an assembly station or in a mold 190. In some examples, the first substrate 110 may be received in a raw material state, or in a pre-formed state already including the recess 140. Receiving as described herein may include any of receiving, providing and/or forming the first substrate from a raw substrate, a substrate blank a substrate, pre-form, or a substrate that is in its final form. In other words, receiving any of the substrate materials may include or exclude forming operations to convert the substrate material to another form.

In some examples, receiving the first substrate may also include forming the first substrate 110 from a blank material to a pre-form or intermediate form having the substantially cylindrical shape including the first surface 104 opposite the second surface 106, and the circumferential outer surface 108 extending from the first surface 104 to the second surface 106. This operation may also include forming the recess 140 into the first surface 104. The formed recess 140 may be arranged to accommodate the additive 120 and at least a portion of the second substrate 130 therein.

Receiving the first substrate 110 may include receiving multiple pieces of substrate, including substrates that may have been partially, but not necessarily completely formed into the sports apparatus 100. In some examples the shape of the first substrate 110 may be similar to the shape of the final components, but the first substrate 110 may also be different from the shape of the final components. In some cases, one or more of the pre-forms may even be substantially the same as the final components or the same as the final components. In some other examples, the substrate may be a raw material. A substrate may also refer to any one of multiple different forms or pre-forms that the components take on at various points during the manufacturing process. Receiving the first substrate may also include receiving a pre-form in the form of a blank or extruded form (e.g. the product of a pultrusion machine) that requires further being cut or formed into multiple pre-forms.

Figure 3B:
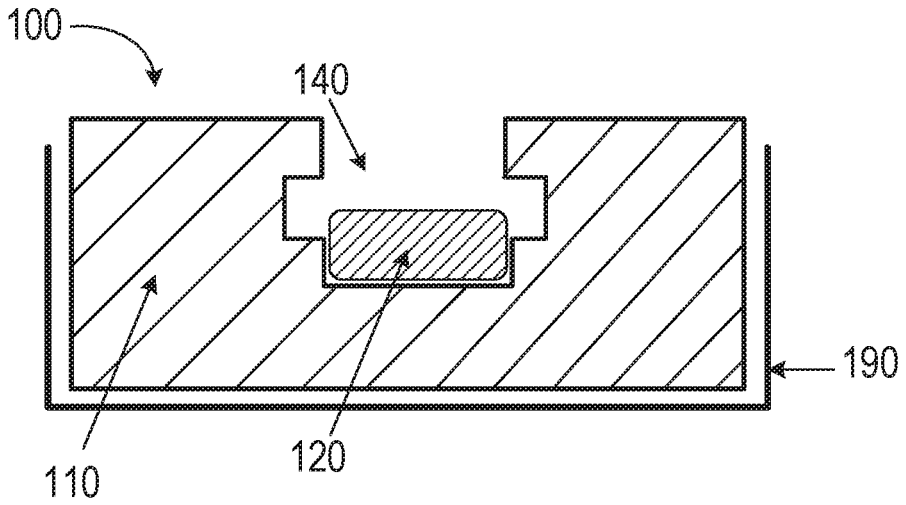

In operation 420 and as shown in FIG. 3B the additive 120, may be received, for example at the assembly station or mold 190, and in operation 430 the additive 120 may be inserted into the recess 140 in the first substrate 110.

In operation 440 and as shown in FIG. 2C, the second substrate 130 may be received, and in operation 450 the second substrate 130 may be inserted into the recess 140, sandwiching the additive 120 between the first substrate 110 and the second substrate 130.

Figure 3C:
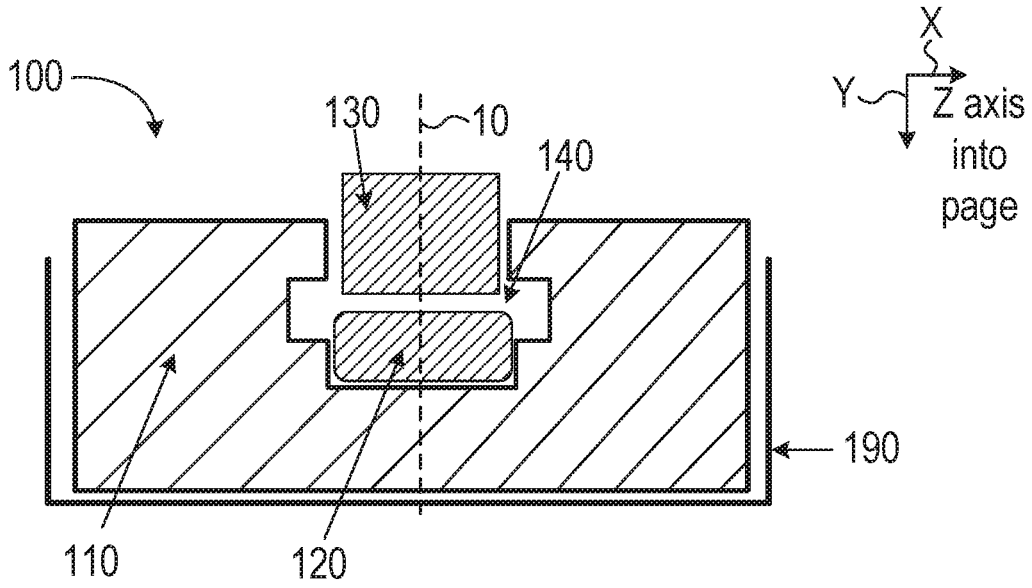

As described above with respect to receiving the first substrate 110, the second substrate 130 may also be received in a shape that is ready for insertion into the recess, or may require additional forming. For example, the shape of the received first and second substrates 110, 130 may be similar, different, the same or substantially the same shape as the form of the final components. As shown in the example of FIG. 3C, the second substrate 130 may be inserted into the recess 140 with a portion of the second substrate 130 remaining above the first surface 104 of the sports apparatus 100 (FIG. 3C).

In some examples, the second substrate 130 may be coupled to the additive 120, which may be coupled to the second substrate 130 before insertion into the recess 140 such that the additive 120 and the second substrate 130 are inserted into the recess 140 jointly. For example, the additive 120 may be molded or adhered to the second substrate 130. In some examples, the additive 120 may instead be adhered to the first substrate 110 (e.g., by an adhesive or interlock) to hold the additive 120 in place during manufacturing and/or use in sports.

Figure 3D:
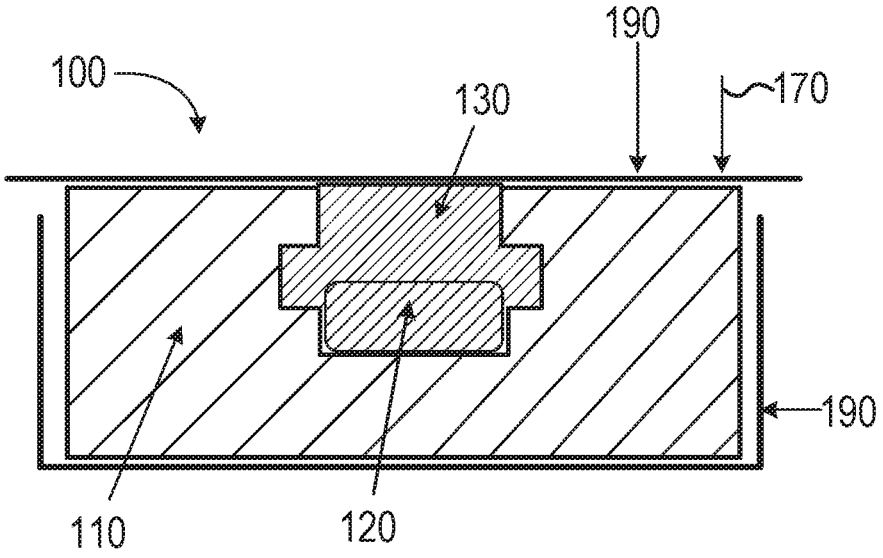

Operation 460, shown in FIG. 3D, may include forming the substrate material into the body of the sports apparatus 100. In some examples, forming the substrate material 102 into the body of the sports apparatus 100 may include: molding the second substrate 130 while the second substrate 130 is located in the recess 140 (FIG. 3C) of the first substrate 110. This allows the second substrate 130 to be formed together with the first substrate 110 such that the final form locks the second substrate 130 into the first substrate 110 to retain the additive 120 within the sports apparatus 100.

In some examples the forming operation 460 may be a vulcanized rubber forming process. In other examples, one or both of the first and second substrates 110, 130 may be formed by other processes and materials including injection molding or other known processes and materials.

Various machines and processes may be used to manufacture the sports apparatus 100 by machine and/or by hand are described herein. The means may include one or more of: means for receiving, means for forming or molding, means for inserting, means for distributing, means for generating a magnetic field, means for exposing the sports apparatus to the magnetic field, means for heating and controlling heating, means for compressing, and means for controlling the manufacture. The means for controlling the manufacture may include a computer or machine readable medium having instructions for manufacturing the sports apparatus 100, that responsive to being executed with processing circuitry of a computer-controlled device, cause the computer controlled device to implement operations of the method 400.

The operations of the method 400 that may be controlled include, but are not limited to: receiving operations, molding operations including molding operations performed with a mold (similar to mold 190 shown in FIGS. 3A-3D), closing and opening operations, determining material characteristics operations, timing operations, temperature controlling operations, determination of presence operations. Inputs to the computer controlled device may include input and determination operations where input is provided by a user, switch and/or sensor.

The means for receiving the substrate material 102 may include receiving the substrate material 102 from a substrate material manufacturer or distributer. The means for receiving the substrate material 102 may also include receiving the substrate material 102 into the mold 190, wherein the mold 190 may have one or more components having the shape of the sports apparatus 100. The means for receiving, as all the means described herein, may be automated by a machine, completed by a worker, or a combination thereof. The means for receiving may also include a machine or worker that receives the additive 120. Receiving the additive 120 may include inserting the additive 120 into the substrate material 102.

The means for forming the substrate material 102 into a body 114 of the sports apparatus 100 with the additive 120 embedded therein may include a forming machine such as a molding machine. The molding machine may be capable of compressing the substrate material 102. In some examples the molding machine may also be capable of heating the substrate material 102. In some examples the means for forming or molding is a vulcanized rubber forming machine capable of applying compression and/or heating.

In some examples, the means for forming may include an injection molding machine. Any means for forming that is capable of forming the sports apparatus 100 to the desired specifications may be used for any of the forming or molding operations described herein with respect to various examples. Intermediate forming operations may be included in the means for forming, including forming an elongate form by a pultrusion machine, which is then cut into individual blanks followed by additional manufacturing operations.

The means for inserting the additive 120 may include automated insertion of the additive by a machine, or manual insertion of the additive 120 by hand.

Figure 5:
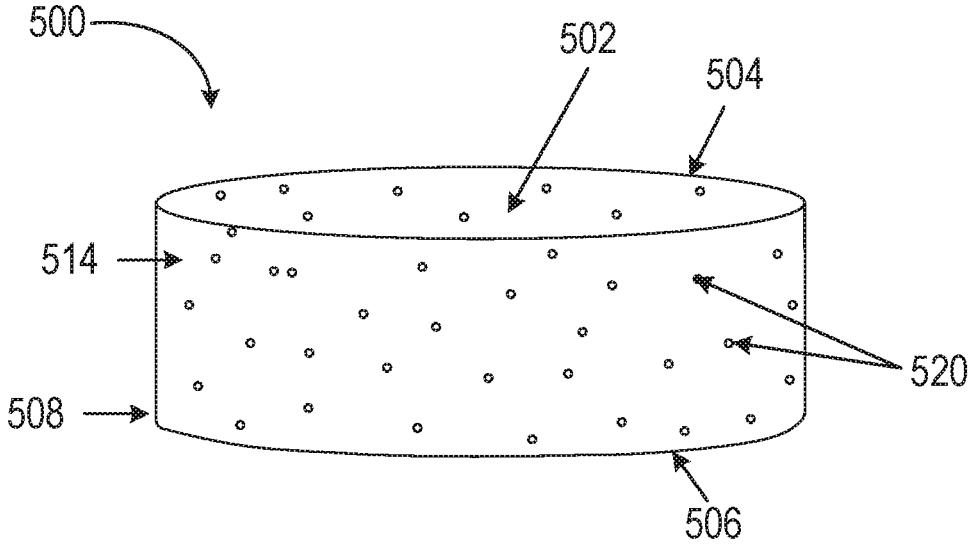
FIG. 5 is a side perspective view illustrating another sports apparatus, shown here in the non-limiting example of a hockey puck including an embedded additive, according to an embodiment.
Figure 6:
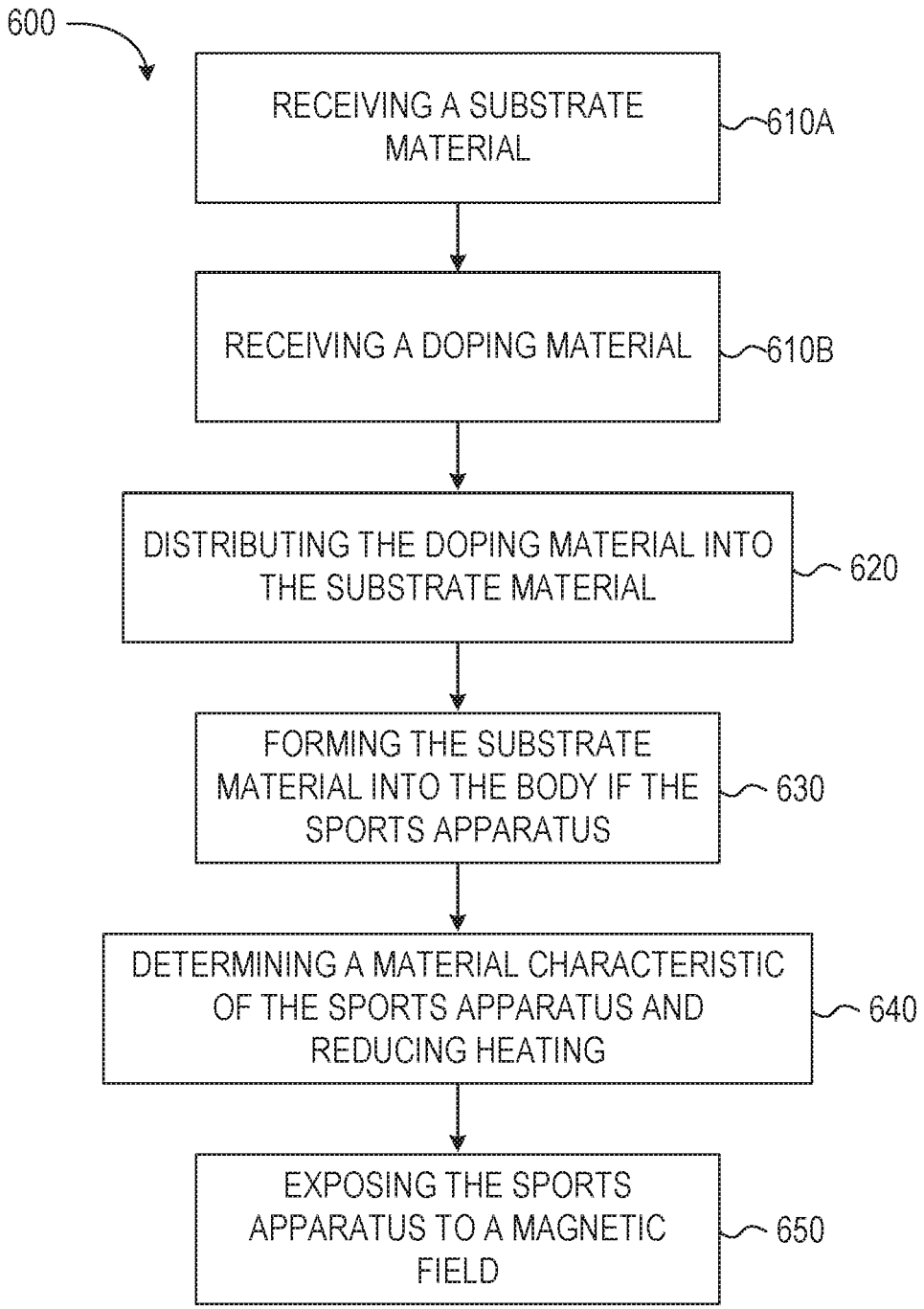
FIG. 6 is a flow chart illustrating a method of manufacturing a sports apparatus of FIG. 5, according to an embodiment.

In the illustrative example of FIG. 5, a sports apparatus 500 includes an additive 520, such as a doping material embedded in the substrate material 502 that forms the body 514 of the sports apparatus 500. The additive 520 may induce a specified magnetic moment 590 (FIGS. 7A, 7B and 8) within the sports apparatus 500, wherein the specified magnetic moment 590 is adapted to be used for tracking location and orientation of the sports apparatus 500. In particular, the additive 520 may have an induced magnetism having a characteristic dipole moment that permits the location of the sports apparatus 500 to be determined by one or more sensors.

Example doping materials may include at least one of: a manganite material, a ferrous material, a rare earth magnetic material, or a combination thereof. The doping material may have a Curie temperature that is less than the bake temperature of the substrate material 502 of the body 514 of the sports apparatus 500 to prevent the specified magnetic moment 590 from being damaged during manufacturing. For example, the Curie temperatures of neodymium magnets (rare earth magnets) may generally be between 100° Celsius (° C.) and 200° C., which are common, very strong, and available for doping. The vulcanizing temperature for most rubber is around 175° C., therefore some rare earth magnets will work, be cheap and readily available, and exist in a doping form. Other magnetic materials exist in the range of −240° C. to 1000° C. in Curie temperature, however the magnetic materials having a Curie temperature at <0° Celsius are pretty rare and expensive.

In some examples the additive 520 may be provided in particulate or powder form. In at least one example, a powder may be defined as particle sizes between 5 nanometers (nm) −120 micrometers (μm). In a more preferred embodiment, the particle size may be between 2 μm-50 μm.

In some examples, the additive 520 forms between 0.05-3.0% of the body 514 of the sports apparatus 500 by volume or weight. In a preferred example, the additive 520 may form less than 1% of the body 514 of the sports apparatus 500 by volume or weight. A preferred range of the additive amount may be between 0.05% and 1.0%. The amount of additive is selected to provide the necessary tracking capabilities, without being so concentrated as to cause the sports apparatus such as a puck to be attracted to and stick to skate blades and other metal objects.

The additive 520 may be mixed into the substrate material 502 according to any suitable method (e.g., method 400 of FIG. 4). In some examples, the additive 520 may be mixed into the substrate material 502 by a machine having adjacent metal rollers that turn in opposite directions. The substrate material 502 may include natural rubber, antioxidants, bonding materials and other chemicals to achieve a balance of hardness and resilience. In order to account for the additional additive 520 characteristics, the mix of the substrate material 502 may be modified over the substrate material use in a conventional sports apparatus to achieve the characteristics required to meet regulation sports apparatus requirements.

Operation 610A may include receiving the substrate material 502 and operation 610B may include receiving the additive 520. In some examples, receiving the substrate material 502 and receiving the additive 520 may include receiving a substrate material 502 having an additive 520 already distributed therein. If the substrate material 502 and the additive 520 are not yet combined, operation 620 may include distributing the additive 520 into the substrate material 502.

Operation 630 may include forming the substrate material 502 into the shape of the body 514 of the sports apparatus 500. In some examples, forming the substrate material 502 may be accomplished by molding. Molding may be performed by inserting the substrate material 502 into a mold (such as the mold 190 in FIG. 3D), closing the mold 190 and applying pressure (e.g., FIG. 3D, 170). The molding process may include heating and/or compressing the substrate material 502. Previous aspects of the forming or molding operations described with respect to the example sports apparatus 200 and associated method 400 may be applicable.

The molding process may be controlled by at least one machine-readable medium that includes instructions for manufacturing a sports apparatus 500 that, responsive to being executed with processing circuitry of a computer-controlled device, causes the computer-controlled device to receive information about a presence of a substrate material 502 and the presence of and an additive 520 in a mold 590. The mold 590 being shaped to produce a body 514 of a sports apparatus 500.

Upon receiving information that the substrate material 502 and the additive 520 are in the mold (e.g., such as mold 190 of FIG. 3D), the mold is caused to be closed to form the substrate material 502 into the body 514 of the sports apparatus 500 and to apply compression and/or heating to do so. The temperature to which the mold is heated may be determined, at least in part, based on the bake temperature of the substrate material 502 and the Curie temperature of the additive 520. In some examples, the instructions may include that upon a determination that the sports apparatus 500 has been formed, cooling of the sports apparatus 500 may be initiated.

Once the body 514 of the sports apparatus 500 is formed with the additive 520 embedded therein, operation 640 of the method 600 may include determining if a material characteristic of the sports apparatus 500 has reached a specified material characteristic. If it is determined that the specified material characteristic has been reached, operation 640 may include reducing or discontinuing the heat and or pressure applied to the substrate material 502 during the molding process and to allow the sports apparatus 500 to cool or relax. The material characteristic may be determined by any suitable material characteristic sensor or other input.

The specified material characteristic of operation 640 may be any material characteristic. In the example method 600, the material characteristic may be temperature. The determination of temperature may be determined via data received from a temperature sensor, the instructions to determine if the material characteristic has reached a specified material characteristic may include determining if the sports apparatus 500 has reached a specified temperature during the cooling process.

In some examples, a determination of temperature may be based on measured data, in other examples, the determination of temperature may be based on empirical data related to when the sports apparatus 500 is expected to reach a desired temperature. For example, the instructions may include instructions to determine if the material characteristic has reached a specified material characteristic based on the amount of time that has elapsed since cooling of the sports apparatus 500 was initiated, the ambient temperature in the room, or other factors.

Operation 650 may include generating a magnetic field 570 (if such a field is not already present), and exposing the sports apparatus 500 to the magnetic field 570 to induce a specific magnetic moment 590 within the sports apparatus 500. In some examples, the temperature determination and the cooling process may be an important aspect in inducing a specific magnetic moment 590 within the apparatus 500. The combination of the additive 520 and the exposure to the magnetic field 570 result in the sports apparatus 500 having a magnetic moment 590 that may be adapted to be used for determining at least one or both of location and orientation of the sports apparatus 500.

When molding is complete and the heat is discontinued or removed, the additive 520 (e.g., magnetic material) cools back down. Before the sports apparatus 500 reaches the Curie temperature, the application of the magnetic field 570 may uniformly or locally induce the magnetic moment 590. The magnetic field 570 may continue to be applied as the sports apparatus 500 is cooled below the Curie temperature, leaving the magnetic moment 590 permanently fixed in a given configuration.

For this reason, exposing the sports apparatus 500 to the magnetic field 570 may include exposing the sports apparatus 500 to a specified magnetic field 570 at a specified temperature, or within a range of specified temperatures. In some examples, the Curie temperature of the additive 520, and the bake temperature of the substrate material 502 are important factors. Those material characteristics may be used to determine the optimal temperatures at which to mold the sports apparatus 500 and/or the optimal temperature to expose the sports apparatus 500 to the magnetic field 570. For example, the instructions to determine if the material characteristic has reached a specified material characteristic may be based, at least in part, on the Curie temperature of the doping material.

The method 600 may be performed by a manufacturing apparatus or system comprising means for performing any of the operations of the method 600 as described herein. Further, the method 600 may be performed by at least one computer-readable medium comprising instructions to perform any of the operations of the method 600. The computer-readable medium may include a non-transitory computer-readable medium.

For example, the method 600 for manufacturing a sports apparatus 500 may include a means for receiving a substrate material 502 such as a mold (e.g. mold 190). The method 600 may also include a means for receiving an additive 520 which may be in the form of a doping material. The additive 5:20 may be used by a sensor array to locate the position of the sports apparatus 500 in relation to a sports goal. The method 600 may also include a means for forming the substrate material 502 into a body 514 of the sports apparatus 500 with the additive 520 embedded therein. The means for forming may include a molding machine, including a first portion of a mold cavity in combination with a second portion of a mold cavity (e.g. 190, FIG. 3D). The means for forming may include vulcanized rubber forming.

Figure 7A:
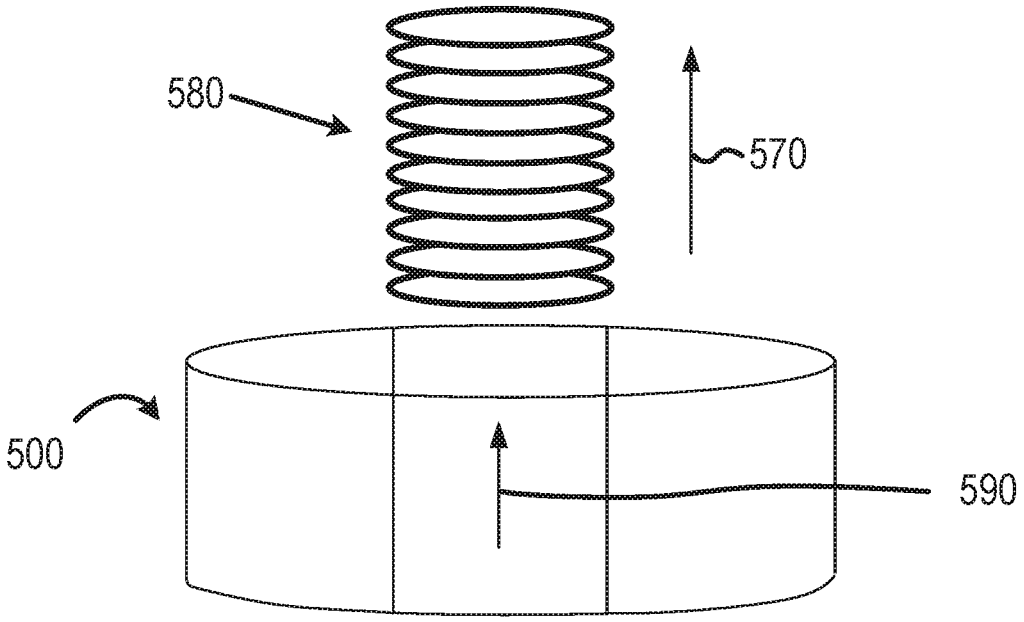
FIGS. 7A-7B are side perspective views of a sports apparatus being exposed to one or more local field generators, according to an embodiment.
Figure 7B:
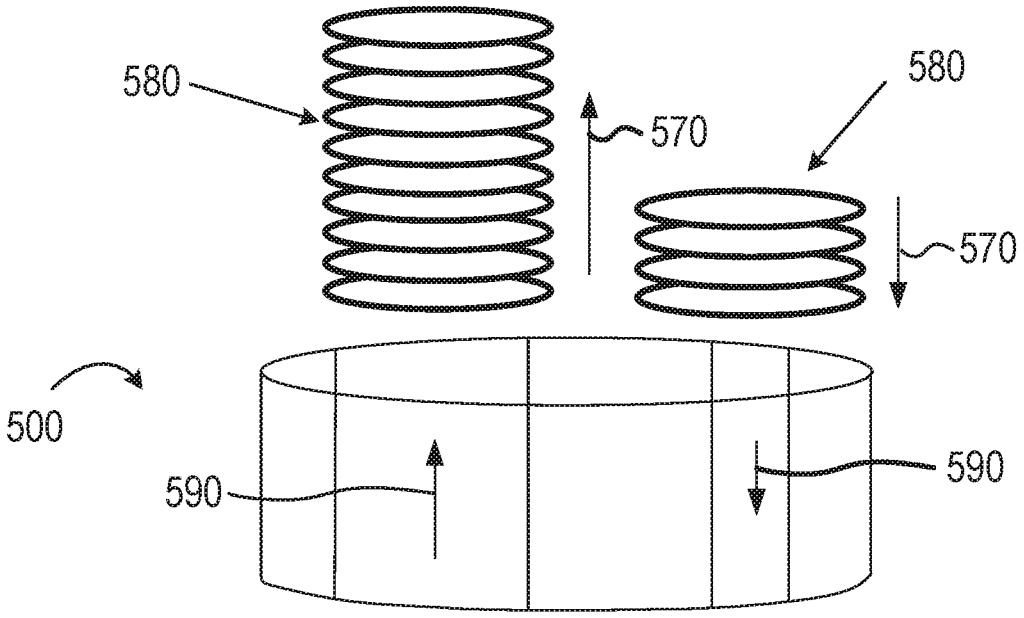
Figure 8:
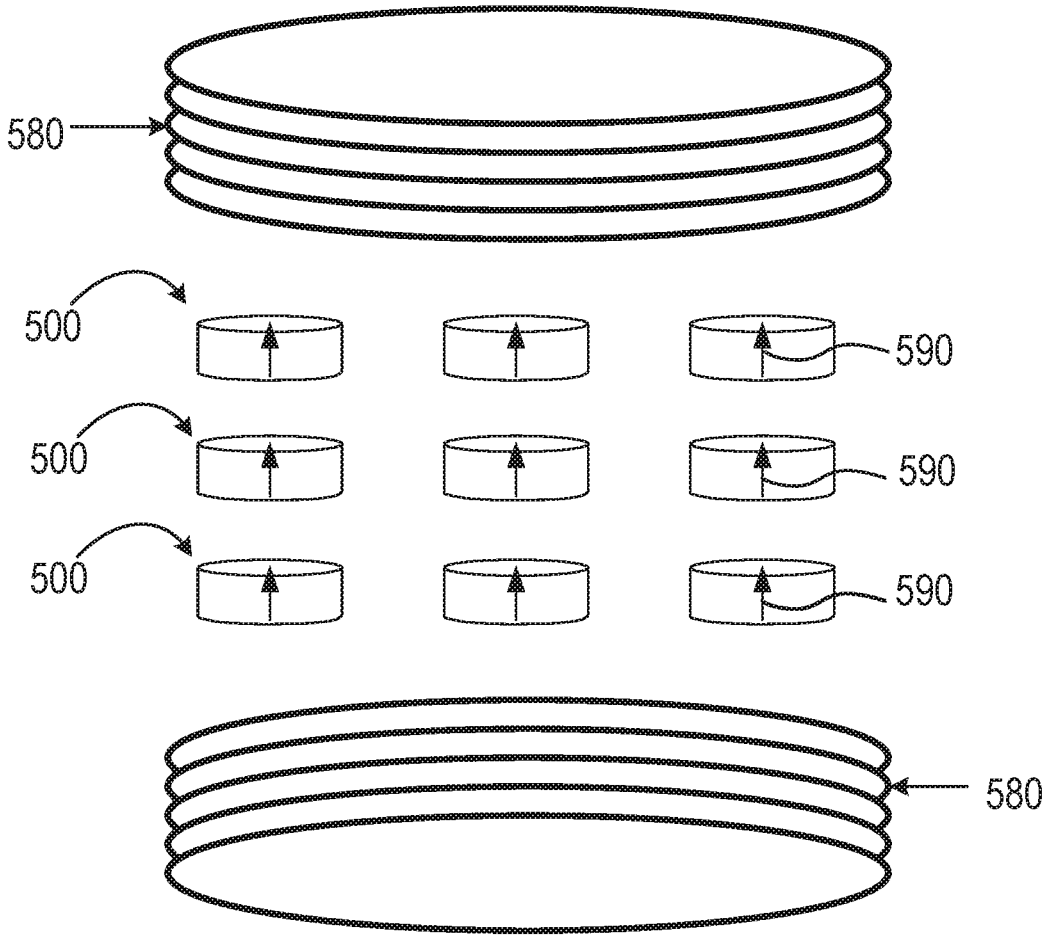
FIG. 8 is a side perspective view of a plurality of sports apparatus being exposed to a local field generator, according to an embodiment.

FIGS. 7A, 7B and 8 show three example arrangements for exposing the sports apparatus 500 to the magnetic field 570, according to various embodiments.

FIG. 7A is a side perspective view of a sports apparatus 500 being exposed to a magnetic field 570 in accordance with the method 600 described above. In some examples, the magnetic field 570 may be provided by a local magnetic field generator 580 that is built into each individual mold (e.g. like mold 190 in FIG. 3D). The magnetic field generator 580 may activate/deactivate electronically at a specific temperature. In some examples, this function may be controlled by processing circuitry, such as processing circuitry 900 of FIG. 9.

Similarly, FIG. 7B is a side perspective view of a sports apparatus 500 being exposed to a plurality of magnetic field generators 580. The plurality of magnetic field generators 580 may be used to create a unique pattern in the sports apparatus 500, such as a checkerboard pattern or other pattern. Alternatively, instead of using a plurality of magnetic field generators 580, a unique pattern may also be created using a single magnetic field generator on a pivot or motion platform with a varying current.

FIG. 8 shows a side perspective view of a plurality of sports apparatus 500 being exposed to a magnetic field generator 580. The arrangement of FIG. 8 may induce uniform magnetic moments 590 in the plurality of sports apparatus 500.

In addition to the various means previously described with respect to manufacturing the example sports apparatus 100 of FIGS. 1A, 1B, 2A and 2B, 3A-3D and 4, other means know in the art, and equivalent means, in addition to those specified here may be provided to manufacture the sports apparatus 500 of FIGS. 5, 6, 7A, 7B and 8.

Various manufacturing means, including the means previously described with respect to the sports apparatus 300 may be applied to the manufacture of sports apparatus 500. Other means that may be used will now described.

For example, a means for distributing the additive 520 into the substrate material 502 may be provided. The means for distributing may include a machine capable of mixing the additive 520 into the substrate material 502 by an automated method 400, such as by adjacent rollers rotating in opposing directions that blend the additive 520 into the substrate material 502. Any suitable automated mixing method may be used as the means for distributing. The means for distributing may also be performed by hand mixing.

A means for generating a magnetic field 570 may include a machine capable of generating a magnetic field 570 (magnetic field generator 580) including, but not limited to: halbach arrays, ruben coils, helmholtz coils, merritt coils, anisotropic magnetoresistance and giant magnetoresistance (AMR/GMR) write heads.

A means for exposing the sports apparatus 500 to the magnetic field 570 may include any automated or manual means for placing the sports apparatus 500 in proximity to the magnetic field 570. The means may include an assembly line that moves the sports apparatus 500 into place in relation to the magnetic field generator 580.

Various machines and processes may be used to manufacture the sports apparatus 500 by machine and/or by hand. The means may include one or more of: means for receiving, means for forming, means for molding, means for inserting, means for distributing, means for generating a magnetic field, means for exposing the sports apparatus to the magnetic field, means for heating, means for controlling heating (e.g., heating, reducing or discontinuing heating), means for compressing, or other means for controlling the manufacture, including a computer readable medium having instructions for manufacturing the sports apparatus 500, that responsive to being executed with processing circuitry 900 (FIG. 9) of a computer-controlled device, cause the computer controlled device to implement operations of the method 600.

The operations of the method 600 that may be controlled include, but are not limited to: receiving operations, molding operations including molding operations performed with mold (e.g., such as mold 190 shown in FIGS. 3A-3D), closing and opening operations, determining material characteristics operations, timing operations, temperature controlling operations, determination of presence operations; generating and exposing operations related to the magnetic field (FIGS. 7A, 7B and 3). Inputs to the computer controlled device may include input and determination operations where input is provided by a user, switch and/or sensor.

Figure 9:
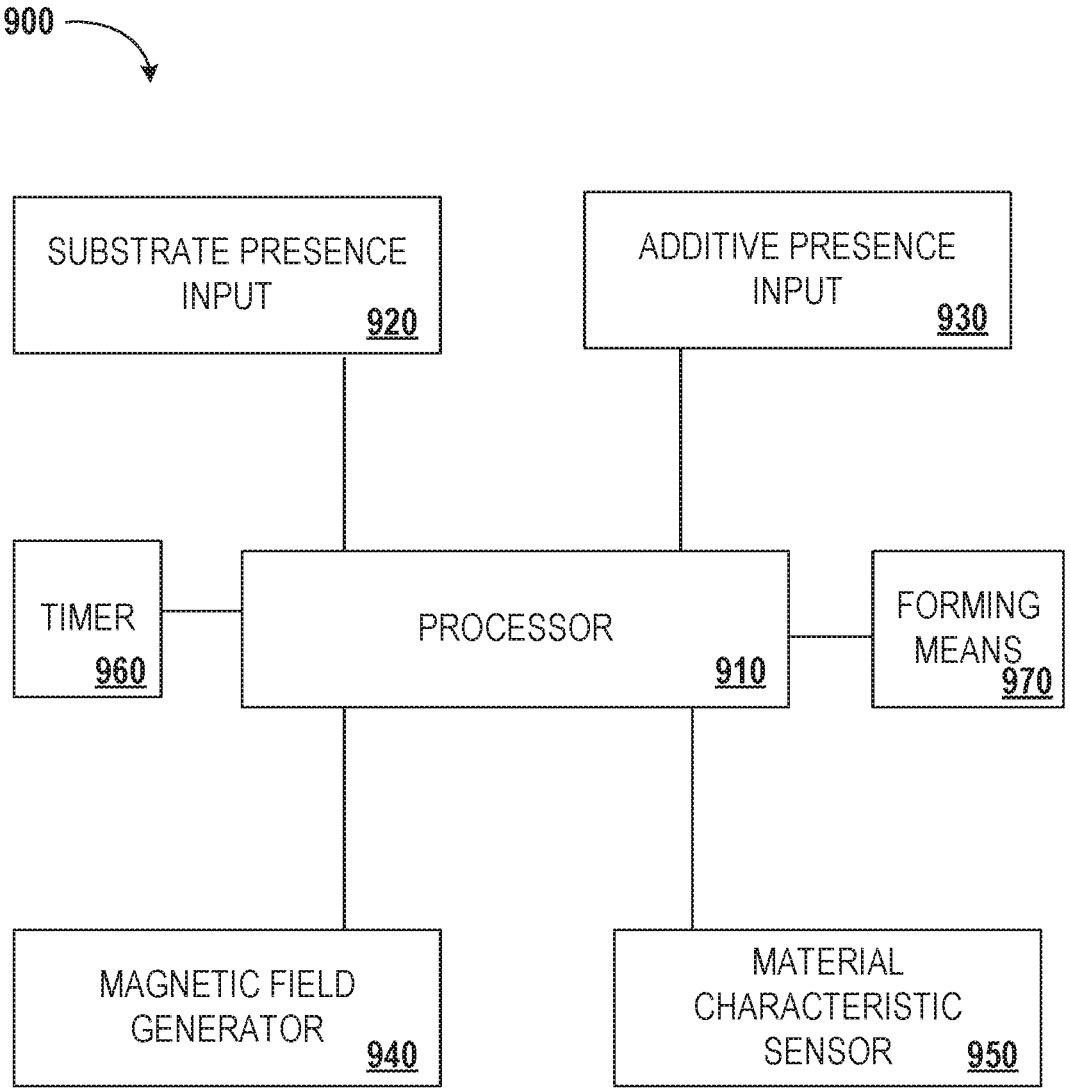
FIG. 9 shows an example of processing circuitry that may be utilized to perform the methods described herein, according to an embodiment.

As shown in FIG. 9, processing circuitry 900 may be provided to perform any of the methods described herein. Processing circuitry 900 may include a processor 910 coupled with a substrate presence input 920 to determine if the substrate material is present, an additive presence input 930 to determine if the additive (e.g. 520) is present, a material characteristic sensor 950 (e.g., temperature sensor) to determine a material characteristic, a magnetic field generator 940 (such as 580 of FIG. 7A), a timer 960 (this may be a feature of the processor), and finally, the forming means 970 (such as the mold 190 of FIG. 3D), The processing circuitry 900 is not limited to the above electrical communications but is provided merely for illustration.

The above description includes references to the accompanying drawings, which form a part of the detailed description. The drawings show, by way of illustration, specific embodiments in which the invention may be practiced. These embodiments are also referred to herein as "examples." Such examples may include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Geometric terms, such as "parallel", "perpendicular", "round", or "square", are not intended to require absolute mathematical precision, unless the context indicates otherwise. Instead, such geometric terms allow for variations due to manufacturing or equivalent functions. For example, if an element is described as "round" or "generally round," a component that is not precisely circular (e.g., one that is slightly oblong or is a many-sided polygon) is still encompassed by this description.

Method examples described herein may be machine or computer-implemented at least in part. Some examples may include a computer-readable medium or machine-readable medium encoded with instructions operable to configure an electronic device to perform methods as described in the above examples. An implementation of such methods may include code, such as microcode, assembly language code, a higher-level language code, or the like. Such code may include computer readable instructions for performing various methods. The code may form portions of computer program products. Further, in an example, the code may be tangibly stored on one or more volatile, non-transitory, or non-volatile tangible computer-readable media, such as during execution or at other times. Examples of these tangible computer-readable media may include, but are not limited to, hard disks, removable magnetic disks, removable optical disks (e.g., compact disks and digital video disks), magnetic cassettes, memory cards or sticks, random access memories (RAMS), read only memories (ROMs), and the like.

The above description is intended to be illustrative, and not restrictive. For example, the above-described examples (or one or more aspects thereof) may be used in combination with each other. Other embodiments may be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments may be combined with each other in various combinations or permutations. The scope of the invention should be determined with reference to the appended claims, along with the full scope of equivalents to which such claims are entitled.

Various Notes and Examples

To better illustrate the method and apparatuses disclosed herein, a non-limiting list of embodiments is provided here.

Example 1 is a sports apparatus for sensing a scoring event, the apparatus comprising: a body formed of substrate material; and an additive embedded in the substrate material, the additive used by a sensor array to locate the position of the sports apparatus in relation to a sports goal, wherein the additive comprises at least one of an electronic object or a doping material.

In Example 2, the subject matter of Example 1 optionally includes wherein the additive is the electronic object and wherein the body is formed of a first substrate and a second substrate.

In Example 3, the subject matter of Example 2 optionally includes wherein the first substrate is formed having a first surface opposite a second surface, and a circumferential outer surface extending from the first surface to the second surface, the first surface having a recess that is configured to accommodate the electronic object and the second substrate therein, and wherein the electronic object is located between the first substrate and the second substrate.

In Example 4, the subject matter of Example 3 optionally includes wherein the recess comprises a first diameter at a first location along a longitudinal axis of the apparatus, and a second diameter at a second location along the longitudinal axis of the apparatus, wherein the first diameter is smaller than the second diameter, and wherein the first location is located closer to the first surface than the second location.

In Example 5, the subject matter of any one or more of Examples 3-4 optionally include wherein the recess comprises a first cross-section at a first location along a longitudinal axis of the apparatus, and a second cross-section at a second location along the longitudinal axis of the apparatus, wherein the first cross-section is different in size, shape or orientation than the second cross-section.

In Example 6, the subject matter of any one or more of Examples 3-5 optionally include the recess further comprising first and second cross-sectional areas defined along a plane orthogonal to a longitudinal axis of the apparatus, wherein the recess comprises a first cross-sectional area at a first region along the longitudinal axis of the apparatus, and a second cross-sectional area at a second region along the longitudinal axis of the apparatus, wherein the first cross-sectional area is smaller than the second cross-sectional area, and wherein the first region is located more distal from the base of the recess than the second region.

In Example 7, the subject matter of any one or more of Examples 3-6 optionally include wherein the second substrate has a stepped cylindrical form comprising a first portion and a second portion along the longitudinal axis of the apparatus, the second portion arranged closer to the electronics than the first portion, and wherein the second portion has a larger cross-sectional area than the first portion.

In Example 8, the subject matter of any one or more of Examples 4-7 optionally include wherein the electronic object is a non-powered passive electronic object.

In Example 9, the subject matter of any one or more of Examples 4-8 optionally include wherein the electronic object is an active powered electronic object.

In Example 10, the subject matter of any one or more of Examples 1-9 optionally include wherein the additive is the doping material, and wherein the doping material induces a specified magnetic moment within the sports apparatus, wherein the specified magnetic moment is adapted to be used for tracking location and orientation of the sports apparatus.

In Example 11, the subject matter of Example 10 optionally includes wherein the doping material comprises at least one of: a manganite material, a ferrous material, a rare earth magnetic material, or a combination thereof.

In Example 12, the subject matter of any one or more of Examples 10-11 optionally include wherein the doping material is in powder form.

In Example 13, the subject matter of any one or more of Examples 10-12 optionally include less than 1% of the body of the sports apparatus.

In Example 14, the subject matter of any one or more of Examples 10-13 optionally include wherein the Curie temperature of the doping material is less than the bake temperature of the body.

In Example 15, the subject matter of any one or more of Examples 10-14 optionally include wherein the doping material comprises an induced magnetism having a characteristic dipole moment that permits the location of the sports apparatus to be determined by the one or more sensors.

Example 16 is a method of manufacturing a sports apparatus, the method comprising: receiving a substrate material; receiving an additive comprising at least one of an electronic object or a doping material, wherein the additive is used by a sensor array to locate the position of the sports apparatus in relation to a sports goal; and forming the substrate material into a body of the sports apparatus with the additive embedded therein.

In Example 17, the subject matter of Example 16 optionally includes wherein the additive is the electronic object, and wherein receiving the substrate material comprises receiving a first substrate and a second substrate, and wherein forming the substrate material into the body of the sports apparatus comprises forming the first substrate to have a substantially cylindrical shape including a first surface opposite a second surface along a longitudinal axis of the apparatus, and a circumferential outer surface extending from the first surface to the second surface, and forming a recess into the first surface, the recess arranged to accommodate the electronic object and at least a portion of the second substrate therein.

In Example 18, the subject matter of Example 17 optionally includes inserting the electronic object and the second substrate into the recess formed in the first substrate, wherein forming the substrate material into a body of the sports apparatus comprises molding the second substrate while the second substrate is located in the recess of the first substrate, to lock the second substrate into the first substrate to retain the electronic object within the sports apparatus.

In Example 19, the subject matter of any one or more of Examples 16-18 optionally include distributing the doping material into the substrate material, and wherein forming the substrate material comprises molding the substrate material by compressing the substrate material.

In Example 20, the subject matter of any one or more of Examples 16-19 optionally include distributing the doping material into the substrate material, and wherein forming the substrate material comprises molding the substrate material by heating and compressing the substrate material.

In Example 21, the subject matter of any one or more of Examples 19-20 optionally include generating a magnetic field and exposing the sports apparatus to the magnetic field to induce a specific magnetic moment within the sports apparatus, and wherein the specific magnetic moment is adapted to be used for determining at least one or both of location and orientation of the sports apparatus.

In Example 22, the subject matter of any one or more of Examples 20-21 optionally include reducing or discontinuing the heat applied to the substrate material during the molding to allow the sports apparatus to cool; and exposing the sports apparatus to a magnetic field.

In Example 23, the subject matter of Example 22 optionally includes wherein exposing the sports apparatus to the magnetic field includes exposing the sports apparatus to a specified magnetic field at a specified temperature.

Example 24 is at least one computer-readable medium comprising instructions to perform any of the methods of Examples 16-23.

Example 25 is an apparatus comprising means for performing any of the methods of Examples 16-23.

Example 26 is at least one machine-readable medium including instructions for manufacturing a sports apparatus that, when executed by a processor, cause the processor to: receive information about a presence of a substrate material and a presence of and an additive in a mold; cause the mold to close, upon receiving information that the substrate material and the additive is in the mold, wherein the mold is shaped to produce a body of a sports apparatus, and the additive comprises at least one of an electronic object or a doping material, wherein the additive is used by a sensor array to locate the position of the sports apparatus in relation to a sports goal; cause the mold to compress and heat the substrate material, upon determination that the mold is closed, to form the substrate material into the body of the sports apparatus; and initiate, upon a determination that the sports apparatus has been formed, cooling of the sports apparatus.

In Example 27, the subject matter of Example 26 optionally includes wherein the additive comprises the electronic object, and wherein the instructions to receive information about a presence of a substrate material includes to receive information about the presence of a first substrate and a second substrate, including information that the additive is located between the first substrate and the second substrate.

In Example 28, the subject matter of any one or more of Examples 26-27 optionally include wherein the additive comprises the doping material, and the doping material is capable of exhibiting a specified magnetic moment within the sports apparatus to track location and orientation of the sports apparatus.

In Example 29, the subject matter of Example 28 optionally includes instructions to: receive information about a material characteristic of the sports apparatus; determine if the material characteristic has reached a specified material characteristic; generate a magnetic field; and expose, upon determining that the material characteristic has reached the specified material characteristic, the sports apparatus to the magnetic field.

In Example 30, the subject matter of Example 29 optionally includes wherein the instructions to determine if the material characteristic has reached the specified material characteristic include determining if the sports apparatus has reached a specified temperature during the cooling process.

In Example 31, the subject matter of any one or more of Examples 29-30 optionally include wherein the Curie temperature of the doping material is less than the bake temperature of the substrate material, and wherein the instructions to determine if the material characteristic has reached a specified material characteristic are based, at least in part, on the Curie temperature of the doping material.

In Example 32, the subject matter of any one or more of Examples 29-31 optionally include wherein the instructions to determine if the material characteristic has reached a specified material characteristic is based on the amount of time that has elapsed since cooling of the sports apparatus was initiated.

In Example 33, the subject matter of any one or more of Examples 29-32 optionally include wherein the instructions to expose the sports apparatus to the magnetic field include exposing the sports apparatus to the magnetic field when the sports apparatus is at a specified temperature to induce a specific magnetic moment within the sports apparatus, and wherein the specific magnetic moment is adapted to be used for determining location or orientation of the sports apparatus.

Example 34 is a manufacturing apparatus for manufacturing a sports apparatus comprising: means for receiving a substrate material; means for receiving an additive comprising at least one of an electronic object or a doping material, wherein the additive is used by a sensor array to locate the position of the sports apparatus in relation to a sports goal; and means for forming the substrate material into a body of the sports apparatus with the additive embedded therein.

In Example 35, the subject matter of Example 34 optionally includes wherein the additive is the electronic object, and wherein the means for receiving the substrate material comprises a means for receiving a first substrate and a second substrate, and wherein the means for forming the substrate material into the body of the sports apparatus comprises: means for forming the first substrate to have a substantially cylindrical shape including a first surface opposite a second surface, and a circumferential outer surface extending from the first surface to the second surface; and means for forming a recess into the first surface, the recess arranged to accommodate the electronic object and at least a portion of the second substrate therein.

In Example 36, the subject matter of Example 35 optionally includes means for inserting the electronic object and a second substrate into the recess formed in the first substrate, and wherein the means for forming the substrate material in to a body of the sports apparatus comprises: means for molding the second substrate, while the second substrate is located in the recess of the first substrate, to form a second substrate, that together with the first substrate locks the second substrate into the first substrate and retains the electronics within the sports apparatus.

In Example 37, the subject matter of any one or more of Examples 34-36 optionally include a means for distributing the doping material into the substrate material, and wherein the means for forming the substrate material comprises a means for molding the substrate material by heating and compressing the substrate material.

In Example 38, the subject matter of Example 37 optionally includes a means for generating a magnetic field and exposing the sports apparatus to the magnetic field to induce a specific magnetic moment within the sports apparatus, and wherein the specific magnetic moment is adapted to be used for determining at least one or both of location and orientation of the sports apparatus.

In Example 39, the subject matter of any one or more of Examples 37-38 optionally include means for reducing or discontinuing the heat applied to the substrate material during the molding to allow the sports apparatus to cool; and means for exposing the sports apparatus to a magnetic field.

In Example 40, the subject matter of Example 39 optionally includes wherein the means for exposing the sports apparatus to the magnetic field includes a means for exposing the sports apparatus to a specified magnetic field at a specified temperature.

What is claimed is:

1. A sports apparatus for sensing a scoring event, the apparatus comprising:

a body formed of a substrate material; and an additive embedded in the substrate material, the additive used by a sensor array to locate the position of the sports apparatus in relation to a sports goal, wherein the additive comprises a doping material distributed in the substrate material, and wherein the doping material has an induced magnetism that causes the sports apparatus to have a specified magnetic moment.

2. The sports apparatus of claim 1, wherein the additive further comprises:

an electronic object, and wherein the body is formed of a first substrate and a second substrate.

3. The sports apparatus of claim 2 wherein the electronic object is a non-powered passive electronic object.

4. The sports apparatus of claim 2 wherein the electronic object is an active powered electronic object.

5. The sports apparatus of claim 2, wherein the first substrate is formed having a first surface opposite a second surface, and a circumferential outer surface extending from the first surface to the second surface, the first surface having a recess that is configured to accommodate the electronic object and the second substrate therein, and wherein the electronic object is located between the first substrate and the second substrate.

6. The sports apparatus of claim 5, wherein the recess comprises a first diameter at a first location along a longitudinal axis of the apparatus, and a second diameter at a second location along the longitudinal axis of the apparatus, wherein the first diameter is smaller than the second diameter, and wherein the first location is located closer to the first surface than the second location.

7. The sports apparatus of claim 5, wherein the recess comprises a first cross-section at a first location along a longitudinal axis of the apparatus, and a second cross-section at a second location along the longitudinal axis of the apparatus, wherein the first cross-section is different in size, shape, or orientation than the second cross-section.

8. The sports apparatus of claim 5, wherein the recess comprises first and second cross-sectional areas defined along a plane orthogonal to a longitudinal axis of the apparatus, wherein the recess comprises a first cross-sectional area at a first region along the longitudinal axis of the apparatus, and a second cross-sectional area at a second region along the longitudinal axis of the apparatus, wherein the first cross-sectional area is smaller than the second cross-sectional area, and wherein the first region is located more distal from a base of the recess than the second region.

9. The sports apparatus of claim 5, wherein the second substrate has a stepped cylindrical form comprising a first portion and a second portion along a longitudinal axis of the apparatus, the second portion arranged closer to the electronic object than the first portion, and wherein the second portion has a larger cross-sectional area than the first portion.

10. The sports apparatus of claim 1, wherein the specified magnetic moment is adapted to be used for tracking location and orientation of the sports apparatus.

11. The sports apparatus of claim 1, wherein the doping material comprises at least one of: a manganite material, a ferrous material, a rare earth magnetic material, or a combination thereof.

12. The sports apparatus of claim 1, wherein the doping material is in powder form.

13. The sports apparatus of claim 1, wherein the doping material forms less than 1% of the body of the sports apparatus.

14. The sports apparatus of claim 1, wherein a Curie temperature of the doping material is less than a bake temperature of the body.

15. The sports apparatus of claim 1 wherein the specified magnetic moment is a characteristic dipole moment that permits the location of the sports apparatus to be determined by the sensor array.

16. A sports apparatus for sensing a scoring event, the apparatus comprising:

a body formed of a substrate material including a first substrate and a second substrate; and an additive embedded in the substrate material, the additive used by a sensor array to locate the position of the sports apparatus in relation to a sports goal, wherein the additive comprises an electronic object and wherein the additive further includes a doping material distributed in the substrate material and wherein the doping material has an induced magnetism that causes the sports apparatus to have a specified magnetic moment, wherein the first substrate is formed having a first surface opposite a second surface, and a circumferential outer surface extending from the first surface to the second surface, the first surface having a recess including geometry that is configured to accommodate the electronic object and the second substrate therein, and wherein the electronic object is located between the first substrate and the second substrate, wherein the recess extends along a longitudinal axis from an open end to a base, wherein the recess includes a first region and a second region along a longitudinal axis with the second region closer to the base than the first region, wherein the recess includes a first cross-sectional area in the first region and a second cross-sectional area in the second region, and wherein the first cross-sectional area is smaller than the second cross-sectional area such that the second substrate is retained by the recess geometry formed in the first substrate to lock the second substrate and the electronic object within the recess of the first substrate.

17. The sports apparatus of claim 16, wherein the doping material comprises at least one of: a manganite material, a ferrous material, a rare earth magnetic material in powdered form.

18. The sports apparatus of claim 17, wherein the doping material forms less than 1% of the body of the sports apparatus.

19. A method of manufacturing a sports apparatus, the method comprising:

receiving a substrate material;

receiving an additive including a doping material, wherein the additive is used by a sensor array to locate the position of the sports apparatus in relation to a sports goal, distributing the doping material into the substrate material;

forming the substrate material into a body of the sports apparatus with the additive embedded therein; and exposing the sports apparatus to a magnetic field to induce a specified magnetic moment in the doping material.

20. The method of claim 19, wherein the additive includes an electronic object, and wherein receiving the substrate material comprises receiving a first substrate and a second substrate, and wherein forming the substrate material into the body of the sports apparatus comprises forming the first substrate to have a substantially cylindrical shape including a first surface opposite a second surface along a longitudinal axis of the apparatus, and a circumferential outer surface extending from the first surface to the second surface, and forming a recess into the first surface, the recess arranged to accommodate the electronic object and at least a of the second substrate therein.

21. The method of claim 20, further comprising inserting the electronic object and the second substrate into the recess formed in the first substrate, wherein forming the substrate material into a body of the sports apparatus comprises molding the second substrate while the second substrate is located in the recess of the first substrate, to lock the second substrate into the first substrate to retain the electronic object within the sports apparatus.

22. The method of claim 19, wherein forming the substrate material comprises molding the substrate material by heating and compressing the substrate material.

23. The method of claim 22, further comprising generating the magnetic field to induce the specified magnetic moment within the sports apparatus, and wherein the specified magnetic moment is adapted to be used for determining at least one or both of location and orientation of the sports apparatus.

24. The method of claim 22, further comprising:

reducing a heat applied to the substrate material during the molding to allow the sports apparatus to cool before exposing the sports apparatus to the magnetic field.

25. The method of claim 24, wherein exposing the substrate to the magnetic field includes exposing the substrate to the magnetic field at a specified temperature.

* * * * *